US008636823B2

(12) United States Patent
Rouse

(10) Patent No.: US 8,636,823 B2
(45) Date of Patent: Jan. 28, 2014

(54) SILVER RIBBONS, METHODS OF THEIR MAKING AND APPLICATIONS THEREOF

(75) Inventor: Jason H. Rouse, Martinsville, NJ (US)

(73) Assignee: Ames Advanced Materials Corporation, South Glens Falls, NY (US)

( * ) Notice: Subject to any disclaimer, the term of this patent is extended or adjusted under 35 U.S.C. 154(b) by 0 days.

(21) Appl. No.: 13/128,073

(22) PCT Filed: Sep. 27, 2010

(86) PCT No.: PCT/US2010/050324

§ 371 (c)(1), (2), (4) Date: May 24, 2011

(87) PCT Pub. No.: WO2011/038309

PCT Pub. Date: Mar. 31, 2011

(65) Prior Publication Data

US 2012/0171499 A1 Jul. 5, 2012

Related U.S. Application Data

(60) Provisional application No. 61/246,108, filed on Sep. 26, 2009.

(51) Int. Cl.
*B22F 9/24* (2006.01)
*C22B 11/00* (2006.01)

(52) U.S. Cl.
USPC ..... 75/371; 75/415; 75/427; 75/741; 977/896

(58) Field of Classification Search
USPC ..... 75/371, 415, 427, 741; 977/896
See application file for complete search history.

(56) References Cited

U.S. PATENT DOCUMENTS

| | | | | |
|---|---|---|---|---|
| 5,744,292 | A | 4/1998 | Yoneyama | |
| 6,375,703 | B1 | 4/2002 | Chou et al. | |
| 6,398,854 | B1 | 6/2002 | Aonuma | |
| 6,511,190 | B2 | 1/2003 | Ohgane | |
| 7,261,852 | B2 | 8/2007 | Rinzler et al. | |
| 7,329,301 | B2 | 2/2008 | Chang et al. | |
| 7,491,448 | B2 | 2/2009 | Ovshinsky et al. | |
| 7,585,349 | B2 * | 9/2009 | Xia et al. | 75/371 |
| 7,922,787 | B2 * | 4/2011 | Wang et al. | 75/371 |
| 2004/0180203 | A1 | 9/2004 | Yadav et al. | |
| 2005/0056118 | A1 | 3/2005 | Xia et al. | |
| 2006/0042416 | A1 | 3/2006 | Yoon et al. | |
| 2006/0068025 | A1 | 3/2006 | Chang et al. | |
| 2006/0078454 | A1 | 4/2006 | Tappan et al. | |
| 2006/0252640 | A1 | 11/2006 | Walsh et al. | |
| 2007/0034052 | A1 * | 2/2007 | Vanheusden et al. | 75/362 |
| 2008/0028889 | A1 | 2/2008 | Irizarry-Rivera et al. | |
| 2008/0143906 | A1 | 6/2008 | Allemand et al. | |
| 2008/0210052 | A1 * | 9/2008 | Allemand | 75/300 |
| 2009/0196788 | A1 | 8/2009 | Wang et al. | |
| 2010/0224026 | A1 | 9/2010 | Brennan Fournet et al. | |

OTHER PUBLICATIONS

Jingwei Bai, Yao Qin, Chengyang Jiang, Limin Qi ; Polymer-Controlled Synthesis of Silver Nanobelts and Hierarchical Nanocolumns ; Chemistry of Materials ; Jun. 2007 ; American Chemical Society ; 2007 19 (14), pp. 3367-3369.*

Imai, et al, "Anisotropic Growth of Silver Crystals With Ethylenediamine Tetraacetate and Formation of Planar and Stacked Wires", Department of Applied Chemistry, Faculty of Science and Technology, Keio University, Yokohama, Japan, Received Oct. 8, 2004; Revised Manuscript Received Jan. 18, 2005; Crystal Growth & Design 2005, vol. 5, No. 3, 1073-1077.

Sondi, et al., "Preparation of Highly Concentrated Stable Dispersions of Uniform Silver Nanoparticles", Center for Advanced Material Processing, Clarkson University, Potsdam, NY, Received Apr. 16, 2002; accepted Dec. 16, 2002; Journal of Colloid and Interface Science, 260 (2003) 75-81, available online at www.sciencedirect.com.

Suber, et al., "Polymer-Assisted Synthesis of Two-Dimensional Silver Meso-Structures", Received Dec. 3, 2008; Revised Manuscript Received Apr. 23, 2009; J. Phys.Chem C 2009, 113, 11198-11203.

International Search Report and Written Opinion mailed Nov. 23, 2010; International Application No. PCT/US2010/050324, International Filing Date Sep. 27, 2010; Applicant—Ferro Corporation.

* cited by examiner

*Primary Examiner* — George Wyszomierski
*Assistant Examiner* — Tima M McGuthry Banks

(57) ABSTRACT

A silver salt solution and a reducing agent solution are added to an aqueous dispersing polymer solution to precipitate silver ribbons.

19 Claims, No Drawings

SILVER RIBBONS, METHODS OF THEIR MAKING AND APPLICATIONS THEREOF

BACKGROUND OF THE INVENTION

1. Field of Invention

The present invention relates to a wet chemical method of making silver ribbons, the silver ribbons, and applications for such ribbons in industrial and consumer products. The invention also relates to silver foams made from such ribbons.

2. Description of Related Art

Conventional methods of making silver nanowires and nanorods require seed particles or high temperatures.

Separately, prior art transparent conductive films are conventionally made by depositing on a substrate a conductive metal oxide film, which is usually indium tin oxide (ITO). The use of ITO films is problematic both from cost and environmental standpoints. In many applications, ITO films are brittle and crack easily. Therefore the development of materials that match the transparency and conductivity displayed by ITO films are of commercial interest.

A standard method of imparting conductivity to a non-conductive material is through the incorporation of conductive particles as filler material. For high conductivity applications the filler material is predominantly silver-based in the form of spherical particles or flakes, and mixtures thereof. When the conductivity requirements are less stringent the filler material can include Ag-coated copper particles, Ag-coated aluminum particles, Ag-coated glass particles, as well as other conductive materials. In the case of Ag-coated aluminum particles and Ag-coated glass particles the base material is simply an inert (non-conductive) template on which the Ag is coated in order to form a conductive particle. While the copper base particle may enhance conductivity in Ag-coated copper particles, the chief limitation of using copper base particles is the lack of environmental stability of the copper. In all cases of Ag-coated particles the extra cost and weight of the core particle is incurred.

BRIEF SUMMARY OF THE INVENTION

Based on the state of the art, the development of new particles comprising conductive metals such as Ag is of commercial importance. Improvements in the art of making silver particles and transparent conductive electrodes are required.

The inventors have discovered that the Ag ribbons of the invention are useful in producing transparent conductive films.

Through diligent studies the inventor has determined a way to make ribbons of silver through a wet chemical method and has discovered applications for such ribbons in low density silver solids as well as in electric and electronic applications.

An embodiment of the invention is a method of making silver ribbons, comprising: (a) providing an acidified aqueous dispersing polymer solution, (b) providing an aqueous solution of a reducing agent, (c) providing an aqueous silver salt solution, and (d) adding the silver salt solution and the reducing agent solution to the aqueous dispersing polymer solution to form a final solution having a final solution volume, wherein silver ribbons precipitate.

Another embodiment of the invention is a silver ribbon made by any disclosed synthetic method herein.

Another embodiment of the invention is a method of making a low density solid silver article comprising: (a) dispersing the silver ribbons made by any other disclosed synthetic method herein with water or an organic solvent, and (b) removing the solvent to afford a porous solid silver article.

Yet another embodiment of the invention is a method of making a transparent conductive film comprising: (a) providing silver ribbons made by any synthetic method disclosed elsewhere herein, (b) providing a dispersant, (c) combining the silver ribbons with the dispersant to form a dispersion, (d) contacting at least a portion of a solid substrate with the dispersion, and (e) removing the dispersant.

Yet another embodiment of the invention is a method of making a transparent conductive film comprising: (a) providing silver ribbons having a thickness of less than 250 nanometers, a width of less than 0.5 micron, and a length of greater than 2 microns, (b) providing a dispersant, (c) combining the silver ribbons with the dispersant to form a dispersion, (d) contacting at least a portion of a solid substrate with the dispersion, and (e) removing the dispersant.

One embodiment of the invention describes a method to precipitate Ag ribbons from solution. The ribbon-like particles have the following characteristics: specific surface area (SSA) greater than 2 $m^2/g$; thickness less than 250 nanometers; average width less than 0.5 microns; and average length greater than 2 microns. The high aspect ratio of the ribbons allows the formation of a conductive percolation network at low loadings, and therefore the ribbons are useful as conductive fillers.

When not otherwise specified, dimensions relating to the ribbons of the invention are taken to be "average" dimensions.

DETAILED DESCRIPTION OF THE INVENTION

Silver ribbons are formed through careful control of reaction conditions. High aspect ratio non-spherical Ag ribbons were precipitated from solution with the aid of a polymer. The non-spherical nature of the Ag ribbons is evident through Scanning Electron Microscopy (SEM) analysis wherein the cross-section of the ribbon displays a two-dimensional or pseudo-rectangular cross-section. In contrast, nanowires or nanorods have a circular cross-section and are usually characterized as having a diameter. The flat or two-dimensional morphology of the ribbons of this invention therefore represents a clear distinction versus prior art related to nanowires/rods and importantly their potential uses. The non-spherical Ag ribbons of this invention are conductive and therefore have utility as conductive filler particles.

Silver foam is a low density solid having a highly porous silver structure, which can be described as a sponge, a foam, or an aerogel. To form such a highly porous Ag structure a solution of Ag ribbon-like particles can be either allowed to evaporate or the Ag ribbon-like particles can be collected on a filter. It is believed that physical entanglement of ribbons helps to create a stable porous article. After drying the resulting sponge-like Ag material can have a density of <1.5 $g/cm^3$, compared to 10.5 $g/cm^3$ for bulk silver. The sponge-like Ag material can be further heated to temperatures in the 100-450° C. range to sinter/fuse the constituent Ag ribbon-like particles together to impart increased conductivity and mechanical stiffness. After the drying step and/or sintering/fusing step the Ag sponge-like material can be further processed in to smaller particles to use as conductive filler as a replacement for other Ag-coated particles.

The term "ribbons" is used herein to more accurately describe the products of the methods and reactions disclosed herein. More typically the structures formed herein may be called fibers. Further definitions herein will be used to describe the experimental results that follow. "Quality" ribbons are defined as ribbons according to the invention having surface area above 3 $m^2/g$, SEM indicating substantially straight two-dimensional materials with lengths of 1 to 20 microns or greater. "Satisfactory" ribbons have lengths of 1 to 20 microns or greater and surface area between 2 and <3 $m^2/g$, but also containing a (noticeable) portion of 2-D flakes and spherical-like particles. Finally, "unsatisfactory" product is where the SEM clearly indicates majority of product is non-ribbon and non-two-dimensional in appearance.

In addition to use as conductive fillers, the ribbons disclosed herein can be used as: (a) antimicrobial agents; (b) catalysis substrates; (c) desalination substrates for water purification; (d) supports for energy storage and energy generation; and (e) starting material for the formation of other metal materials such AgCl or $Ag_2O$.

The silver ribbons of the invention are produced by a reaction that reduces a silver salt to silver metal. The reaction involves a silver salt, typically silver nitrate, but other silver salts can be used such as silver chloride, silver bromide, silver iodide, silver phosphate, silver sulfate and other silver salts readily soluble in aqueous media in order to provide $Ag^+$ ions.

The concentration of such silver salts will be such that in a final reaction solution, idealized as the time after all reagents are mixed but before the reaction starts, silver ions ($Ag^+$) are provided to the final solution in a concentration from about 0.001 to about 0.35 M, preferably from about 0.01 to about 0.30 M, more preferably from about 0.02 to about 0.27 M, still more preferably from about 0.03 to about 0.20 M, and even more preferably from about 0.04 to about 0.18 M, still more preferably from about 0.07 to about 0.18 M, and even more preferably about 0.09 to about 0.18 M. "M" means "molarity" or moles per liter as known in the art.

A dispersing polymer is needed for the reactions disclosed herein. Useful dispersing polymers include rigid rod polymers such as the sulfonates, carboxylates and phosphates of naphthalene. Preferred is poly-naphthalene sulfonate, or poly-naphthalene sulfonic acid which is a sulfonated naphthalene polycondensed with formaldehyde.

Commercial versions of poly(naphthalene sulfonate) are available under the Daxad®, Tamol® and Vultamol® trademarks. Daxad® products are sold by Geo Specialty Chemicals, Cleveland, Ohio. Useful Daxad® products include 11, 11G, 11KLS, 12KLS, 14C, 14LLS, 15, 15LS, 16, 16 LLC, and 17. The foregoing products are considered "low molecular weight." "High molecular weight" Daxad® products useful herein include Daxad® 19, 19L42, 19LCA, 19 LS, 19 LS and 19P.

Also useful are the Tamol® and Vultamol® products available from BASF AG, Ludwigshafen, Germany. Tamol® N products are condensation products of naphthalene sulfonic acid, Tamol® NN products have a low degree of polycondensation while Tamol® NH 7519 has a high degree of polycondensation. Useful Tamol® products include $NN_{24}O_6$, NN2901, NN4501, NN7718, NN8906, NN9104, NN9401, NH 7519. Vultamol® NN8906 and NN9104 are also useful. For the Tamol® and Vultamol® products, the first two digits of the numeric product code refer to the active content in percent. The last two digits refer to the sodium sulfate content. The overall solids content is the sum of the active content and the sodium sulfate content. All of these figures are approximate.

It is known that the Daxad®, Tamol®, and Vultamol® products contain as impurities a portion of sodium sulfate. In the examples below, and in production, no effort was made to eliminate such impurities; the Daxad®, Tamol® and Vultamol® are used as-is.

The relative concentrations of silver and dispersing polymer are important for achieving the silver ribbons of the invention. Broadly, the concentration of the poly-naphthalene sulfonic acid in the final solution is about 1 to 100 grams per mole of silver. Preferably, this ratio is about 4 to about 40 grams per mole of silver, more preferably, the concentration of the poly-naphthalene sulfonic acid in the final solution is about 6 to about 35 grams per mole of silver. Still more preferably, this ratio is about 7 to about 30 grams per mole of silver. Even more preferably, this ratio is about 8 to 25 grams per mole of silver.

The dispersing polymer is dissolved in an acid. The acid is typically a strong mineral acid such as NCl, $H_2SO_4$, $HNO_3HClO_4$ and the like. $HNO_3$ is preferred. Acid is provided to the solution of dispersing polymer such that the final acid concentration in the final reaction solution is in the range of 0.001 to 1 M. Preferably this concentration is 0.01 to 0.5 M, more preferably 0.012 to 0.25 M and most preferably 0.015 to 0.15 M. Alternatively a workable acid concentration is achieved by ensuring that the acidified aqueous dispersing polymer solution includes sufficient acid to provide a concentration of about 1 to about 10 mL concentrated acid per liter of final solution. An example of the latter is 1 to 10 mL of concentrated $HNO_3$ (68% by weight) per liter of final solution.

A reducing agent is needed to reduce $Ag^+$ to $Ag^o$. Useful reducing agents include ascorbic acid, erythorbic acid, citric acid, oxalic acid, formic acid, $LiAlH_4$, $NaBH_4$, $SnCl_2$, sulfites, hydrazine ($N_2H_4$) phosphorous acid, phosphites, and sulfites. Salts of the foregoing acids are also suitable. Ascorbic acid, erythorbic acid and their salts are preferred. Ascorbic acid is most preferred.

The reducing agent is provided in an amount such that it is present in the final reaction solution in a concentration of from about 0.001 to about 1 M, preferably from about 0.01 to about 0.5 M, more preferably from about 0.02 to about 0.4M, still more preferably from about 0.03 to about 0.3 M, and most preferably about 0.04 to about 0.25 M, most preferably about 0.05 to about 0.2M.

The silver ribbons of the invention typically are very thin, having a thickness of less than 500 nanometers, preferably less than 400 nanometers, more preferably less than 300 nanometers, yet more preferably less than 250 nanometers, still more preferably less than 200 nanometers and most preferably less than 100 nanometers, all measured by scanning electron microscope (SEM).

The silver ribbons of the invention are typically narrow, having a width of less than 1000 nanometers, preferably less than 800 nanometers, more preferably less than 600 nanometers, still more preferably less than 500 nanometers and most preferably a width of less than 400 nanometers.

The silver ribbons of the invention typically are fairly long, having a length of at least 2 microns, preferably at least 3 microns, successively more preferably 4, 5, 6, 7, 8, and 9 microns. Most preferably the silver ribbons made by the processes disclosed herein are at least 10 microns in length.

Accordingly, the ribbons of the invention have an aspect ratio (length/width) of at least 2, preferably at least 3, more preferably at least 4, more preferably at least 5 and still more preferably at least 10, and most preferably at least 20.

The ribbons of the invention have a significant specific surface area (SSA) as measured by the BET method. The SSA is typically at least 2 $m^2/g$, more preferably at least 2.5 $m^2/g$, still more preferably at least 3 $m^2/g$, yet more preferably at least 4 $m^2/g$ and most preferably at least 5 $m^2/g$.

Porous articles made from the ribbons of the invention have a density of less than 3 $g/cm^3$, yet more preferably less than 2.5 $g/cm^3$, even more preferably less than 2 $g/cm^3$, yet more preferably less than 1.5 $g/cm^3$ and most preferably less than 1 $g/cm^3$.

Various embodiments of the invention relate to methods of making the silver ribbons of the invention as well as their application in conductive coatings, as conductive fillers or in electric or electronic devices.

One embodiment of the invention relates to the precipitation of non-spherical Ag ribbons. The ribbons are formed in the presence of a polymeric dispersant and can have a length of greater then 10 microns as determined by SEM. The non-spherical Ag ribbon has a cross-section that is substantially 2-dimensional. Examples 1, 2, and 3, below, relate to this embodiment.

Another embodiment of the invention relates to the use of the non-spherical Ag ribbons as conductive filler particles in a non-conductive matrix. The high aspect ratio of the ribbons allow for a percolation network to be developed even at low loadings. The Ag ribbons may be used either solely or in conjunction with other conductive filler particles. The non-conductive matrix may include thermoplastics, polymers, ceramics, metals, and the like, and mixtures thereof. Example 5, below, relates to this embodiment. Useful polymers or thermoplastics include poly(butadienes), poly(carbonates), poly(urethanes), poly(ethers), poly(esters), simple hydrocarbons, and simple hydrocarbons containing functionalities such as carbonyl, carboxyl, amide, carbamate, urea, or ether. Commercially available materials include butyl(meth)acrylate, isobutyl(meth)acrylate, 2-ethyl hexyl(meth)acrylate, isodecyl(meth)acrylate, n-lauryl(meth)acrylate, alkyl(meth) acrylate, tridecyl(meth)acrylate, n-stearyl(meth)acrylate, cyclohexyl(meth)acrylate, tetrahydro-furfuryl(meth)acrylate, 2-phenoxy ethyl(meth)acrylate, isobromyl(meth)acrylate, 1,4-butanediol di(meth)acrylate, 1,6 hexanediol di(meth)acrylate, 1,9-nonandiol di(meth)acrylate, perfluorooctylethyl(meth)acrylate, 1,10 decandiol di(meth)acrylate, nonylphenol polypropoxylate(meth)acrylate, and polypentoxylate tetrahydrofurfuryl acrylate, polybutadiene urethane dimethacrylate, polybutadiene dimethacrylate; polycarbonate urethane diacrylate; acrylated aliphatic urethane oligomers; polyester acrylate oligomers; and epoxy acrylate resins. In one embodiment the acrylate resins are selected from the group consisting of isobornyl acrylate, isobornyl methacrylate, lauryl acrylate, lauryl methacrylate, poly(butadiene) with acrylate functionality and poly(butadiene) with methacrylate functionality.

An embodiment of the invention relates to the use of the Ag ribbons as conductive filler particles in a conductive matrix. The high aspect ratio of the ribbons allow for conductivity enhancement even at low loadings. The Ag ribbons may be used either solely or in conjunction with other conductive filler particles. The conductive matrix may include conductive polymers, conductive metal oxides, conductive metals, and the like, and mixtures thereof.

Another embodiment of the invention relates to the use of the non-spherical Ag ribbons contained within a conductive or non-conductive matrix within a device. The composition containing the non-spherical Ag ribbons of the invention can be applied to the device or individual parts of said device by procedures including screen printing, pad printing, spray deposition, aerosol deposition, flexography, gravure printing, lithography, stencil printing, syringe deposition, and combinations thereof.

An embodiment of the present invention relates to the formation of a conductive transparent film including the non-spherical Ag ribbons. The transparent conductive film can be prepared using the non-spherical Ag ribbons disclosed herein with the optional inclusion of additives such as resin binders, dispersants, surface wetting aids, rheology modifiers, and the like. A transparent conductive film is prepared using a 90/10 (wt %) ratio of non-spherical Ag ribbons to polyvinylpyrrolidone dispersed in a water/methanol blend. The film was prepared by dip coating a glass slide in to the dispersion, allowing the solvent to dry in air, and then heating at 100° C. for 10 minutes. The measured sheet resistance of the film was approximately 20 Ohm/square. Example 4, below, also relates to this embodiment.

Another embodiment of the present invention relates to a method of forming a conductive transparent film containing the non-spherical Ag ribbons and the application of such film (or electrode made from such film) within an electric or electronic device. The conductive transparent film containing non-spherical Ag ribbons of the invention can be applied to the device or individual parts of said device by procedures including screen printing, pad printing, spray deposition, aerosol deposition, flexography, gravure printing, lithography, stencil printing, syringe deposition, and combinations thereof.

An embodiment of the present invention relates to the conversion of the non-spherical Ag ribbons to other Ag compounds such as AgCl or Ag oxide. Such materials can be prepared by appropriate secondary chemical treatment of the non-spherical Ag ribbons. Such materials could have use in applications ranging from antimicrobial agents to energy storage to conductive inks.

Another embodiment of the invention relates to formation of highly porous Ag solids utilizing the non-spherical Ag-ribbons as the predominant building blocks. The highly porous Ag solid can be prepared by taking a slurry (i.e., dispersion) of the Ag-ribbon like particles (1) pouring them into a container and allowing the dispersant to evaporate or (2) filtering the slurry to form a wet cake of the Ag-ribbon like particles and then allowing the dispersant to evaporate. Dispersants include water, aqueous solutions, and organic solvents, such that silver metal is not soluble therein or reactive therewith. "Dispersants" are not the same as the "aqueous dispersing polymer solution." A highly porous Ag solid is prepared by allowing the solvent to evaporate from a slurry at 45° C. The solid made by this embodiment has a density of about 1.2 g/cm$^3$.

An embodiment of the invention relates to the formation of very low density Ag fillers utilizing the highly porous Ag solid as the starting material. A method of producing particles from the highly porous Ag solid is via mechanical screening. For example, to produce low density conductive fillers with a maximum particle size of 100 microns or less a highly porous Ag solid could be screened on a 50 mesh and then a 200 mesh metal screen. Example 8, below, relates to this embodiment.

Another embodiment of the invention relates to high temperature thermal treatment of the highly porous Ag solid in order to sinter/fuse the constituent Ag ribbons together. The porous silver solid made by the evaporation or filtration method above is simply heated in an oven. With proper choice of time and temperature, the morphology of the porous solid may or may not undergo a noticeable change however the density changes very little. A very low density Ag filler produced was via screening of a porous Ag solid after heat treatment at 350° C. for 20 minutes. Example 9, below, relates to this embodiment.

An embodiment of the invention relates to the use of the very low density Ag filler as a conductive filler (electrical/thermal). The measured powder resistance makes these powders ideal for use as electrically conductive filler.

Another embodiment of the invention relates to the use of the very low density Ag filler as a constituent in larger low-density Ag structures. Such structures can be formed by taking the very low density Ag filler and packing the powder in to a mold. Thermal treatment of the structure will then fuse the particles together to a desired degree to produce a mechanically stable Ag monolith with improved electrical and thermal properties.

An embodiment of the invention relates to the conversion of the very low density Ag filler particles in to more flake-like particles. Potential methods for conversion of the particles to flakes include the use of an attritor, a ball mill, or a paint shaker. The media used could be spherical or cylindrical.

A fourteenth embodiment of the invention relates to the use of the very low density Ag filler or low-density flake-like particle as conductive filler in either in a non-conductive or conductive matrix.

A fifteenth embodiment of the invention relates to the use of the low density Ag filler or low-density flake-like particles contained within a conductive or non-conductive matrix within a device. The composition containing the non-spherical Ag ribbons of the invention can be applied to the device or individual parts of said device by procedures including screen printing, pad printing, spray deposition, aerosol deposition, flexography, gravure printing, lithography, stencil printing, syringe deposition, and combinations thereof.

A sixteenth embodiment of the invention relates to use of the highly porous Ag monoliths, very low density Ag particles and flakes as precursors for the formation of other Ag compounds such as AgCl or Ag oxide. Such materials can be prepared by appropriate secondary chemical treatment. Such materials could have use in applications ranging from antimicrobial agents to energy storage to conductive inks.

A seventeenth embodiment of the invention relates to the deposition of non-Ag materials on to the highly porous Ag monoliths, very low density Ag particles and flakes. Depending upon the material deposited on to the Ag structure the new composite could have potential use as a catalysis, energy storage material, or energy generation material.

EXAMPLES

Example 1

A procedure to precipitate non-spherical silver ribbons is as follows. Forty nine grams (49.0) of ascorbic acid is dissolved to a total volume of 600 mL with de-ionized water (DIW) in a glass beaker. To a second beaker 78.8 grams of silver nitrate was dissolved to a total volume of 600 mL with DIW. In a 10 liter beaker, 4.0 liters of DIW water was added followed by 7.9 grams of Daxad® 19 (GEO Specialty Chemicals) and mixed for five minutes. After five minutes, 25 mL of concentrated nitric acid is added to the 10 liter beaker and stirred for one minute. The ascorbic acid and silver nitrate solutions were each added to the stirring beaker at a rate of 3.3 mL/min. The resulting silver ribbons were decant washed with four liters of DIW four times and then dried at 65° C. for 24 hours. The surface area of the precipitated silver ribbons was 4.29 $m^2/g$ and scanning electron microcopy indicated that the ribbon lengths were predominantly in the 1 to 20 micron range. Observation of the Ag ribbon reveals a substantially two-dimensional cross-section.

In Example 2, forty nine grams (49.0) of ascorbic acid is dissolved to a total volume of 600 mL with de-ionized water (DIW) in a glass beaker. To a second beaker 78.8 grams of silver nitrate was dissolved to a total volume of 600 mL with DIW. In a 10 liter beaker, 4.0 liters of DIW water was added followed by 7.9 grams of Vultamol® NN 8906 (BASF Chemicals) and mixed for five minutes. After five minutes, 25 mL of concentrated nitric acid is added to the 10 liter beaker and stirred for one minute. The ascorbic acid and silver nitrate solutions were each added to the stirring beaker at a rate of 3.3 mL/min. The resulting silver ribbons were decant washed with four liters of DIW four times and then dried at 65° C. for 24 hours. The surface area of the precipitated silver ribbons was 4.09 $m^2/g$ and scanning electron microcopy indicated that the ribbon lengths were predominantly in the 1 to 20 micron range.

In example 3, carried out as was example 1, except that Daxad® ® 11 G was used, the surface area of the precipitated silver ribbons was 4.85 $m^2/g$. Scanning electron microcopy indicated that the ribbon lengths were predominantly in the 1 to 15 micron range and that the ribbons were substantially two-dimensional in cross-section.

Example 4

Beginning with silver ribbons prepared according to Example 1, transparent conductive films were formed as follows. An approximately 1 wt % dispersion of a 90/10 (wt %) ratio of non-spherical Ag ribbons to polyvinylpyrrolidone (BASF Luvitec K115) was prepared in a water/methanol blend using a Tekmar homogenizer at 8000 RPM for 5 minutes. A film was prepared by dip coating a glass slide in to the dispersion, allowing the solvent to dry in air, and then heating at 100° C. for 10 minutes. The measured sheet resistance of the film was approximately 20 Ohm/square. The conductive film is transparent in the visible wavelengths.

Example 5

The ability of the Ag ribbons to provide electrical percolation within a polymer resin was determined using Vitel 2200B polyester resin (Bostik Corp.). The Ag ribbons were mixed into a 49.5 wt % solution of Vitel 2200B in methyl ethyl ketone using a Flaktec mixer (2400 RPM for 2 minutes total) at a loading of 20 wt % Ag fiber to total Ag fiber/resin dry weight. Thin films of the resulting solution were made on glass slides and then the films were placed in a 150° C. oven for 30 min to dry. The volume resistivity (mOhm*cm) measured using a 4-point probe of the 20 wt % Ag fiber containing films was 20.6.

Example 7

A highly porous Ag solid was prepared by pouring an aqueous slurry of Ag ribbons prepared according to Example 1 into a metal dish. The dish was placed in to a 45° C. oven and the water was allowed to evaporate leaving a porous solid with a density of about 1.2 $g/cm^3$ after 2 days. For comparison, the bulk density of silver is 10.5 $g/cm^3$; the porous solid is about 89% air. The low-density solid had sufficient mechanical strength to be handled.

Example 8

A portion of the porous solid Ag monolith of Example 7 was further processed in to low-density conductive particles by mechanical screening. The Ag monolith was broken in to small pieces by hand and then with the aid of a brush the particles were screened through a 50 mesh count screen followed by a 200 mesh count screen to produce fine highly porous silver particles. The powder resistivity of the resulting powder was 3.83 mOhm*cm indicating the material was conductive. The surface area of the material was 4.17 $m^2/g$. The density was 1.1 $g/cm^3$.

Example 9

To determine the effect of thermal treatment on the properties of the highly porous silver monoliths samples were heated at various temperatures by placing in a preheated oven for a set time. After the heat treatment the monoliths were broken in to small pieces by hand and then with the aid of a brush the particles were screened through a 50 mesh count screen followed by a 200 mesh count screen to produce fine porous silver particles. The surface area (SSA)—in $m^2/g$—and powder resistivity (PR)—in mOhm*cm—of the particles were determined and the microstructure was probed by SEM. Monolith Density (MD) is given in $g/cm^3$. Heating the monoliths at 350° C. for 20 min caused both a significant decrease in surface area and an improvement in powder resistivity. Observation revealed that the particles were still porous but that at 350° C. the silver ribbons had undergone considerable sintering, revealing a powder having a powder resistivity of 1.22 and a surface area of 0.59, and powder density=1.7.

Heating the monoliths at 400° C. for 20 min caused the powders to have a powder resistivity of 0.73, a surface area of 0.50, and powder density=2.0.

The powder resistivity of the resulting powder was 3.83 mOhm*cm indicating the material was conductive. The surface area of the material was 4.17 $m^2/g$. The density was 1.1 $g/cm^3$.

Further examples are found in Table 1. The batches of Table 1 were prepared generally according to example 1, above, with some changes, detailed in the table.

| Batch | Ag (g) | Daxad (g) | mL HNO3 | Add. Time (h) | SSA | Observation of ribbons from SEM | moles Ag/liter of final solution | Gram Daxad ®/ mole Ag | Gram Daxad ®/ liter | mL $HNO_3$/ Liter of solution |
|---|---|---|---|---|---|---|---|---|---|---|
| 1 | 50 | 7.9 | 25 | 6 | 3.7 | Quality | 0.09 | 16.9 | 1.5 | 4.8 |
| 2 | 100 | 21.7 | 25 | 6 | 2.84 | Satisfactory | 0.18 | 23.3 | 4.2 | 4.8 |
| 3 | 50 | 7.9 | 25 | 3 | 4.90 | Quality | 0.09 | 16.9 | 1.5 | 4.8 |
| 4 | 50 | 7.9 | 25 | 3 | 5.02 | Quality | 0.09 | 16.9 | 1.5 | 4.8 |
| 5 | 100 | 15.7 | 25 | 3 | 4.45 | Satisfactory | 0.18 | 16.7 | 3.0 | 4.8 |
| 6 | 150 | 26.9 | 25 | 3 | 3.91 | Satisfactory | 0.27 | 19.2 | 5.2 | 4.8 |
| 7 | 100 | 21.4 | 2.5 | 6 | 1.68 | Unsatisfactory | 0.18 | 22.9 | 4.1 | 0.5 |
| 8 | 100 | 21.4 | 12.5 | 6 | 3.89 | Quality | 0.18 | 22.9 | 4.1 | 2.4 |
| 9 | 100 | 21.4 | 25 | 6 | 3.09 | Unsatisfactory | 0.18 | 22.9 | 4.1 | 4.8 |
| 10 | 100 | 10.7 | 25 | 6 | 3.45 | Quality | 0.18 | 11.3 | 2.1 | 4.8 |
| 11 | 100 | 2.7 | 12.5 | 6 | 2.04 | Satisfactory | 0.18 | 2.9 | 0.5 | 2.4 |
| 12 | 100 | 1.3 | 12.5 | 6 | 1.22 | Unsatisfactory | 0.18 | 1.3 | 7.2 | 2.4 |
| 13 | 100 | 32.6 | 12.5 | 6 | 2.65 | Satisfactory | 0.18 | 34.8 | 6.3 | 2.4 |

In table 1, "Ag(g)" means grams of silver added. The silver is added in the form of $AgNO_3$ and the amount in the table is the amount of silver contributed by such salt. Daxad® is Daxad® 19. The volume of added $HNO_3$ is in terms of concentrated (68%) $HNO_3$ in the aqueous solution of the reducing agent (ascorbic acid). "Add time" is time over which the addition of the silver solution and the aqueous solution of the reducing agent are added to the aqueous dispersing polymer solution. SSA is specific surface area of the product in $m^2/g$ according to the BET method. "Observation of ribbons from SEM" is according to the rating scheme (quality, satisfactory, unsatisfactory) disclosed previously herein. The final four columns give concentrations of Daxad®, silver and $HNO_3$ in clear terms, related to the final solution. The amount of ascorbic acid used in each batch of table 1 is a fixed relationship to the amount of silver provided, that being 0.61 moles ascorbic acid per mole of silver.

Certain embodiments of the invention are envisioned where at least some percentages, temperatures, times, and ranges of other values are preceded by the modifier "about." "Comprising" is intended to provide support for "consisting of" and "consisting essentially of." Where ranges in the claims of this provisional application do not find explicit support in the specification, it is intended that such claims provide their own disclosure as support for claims or teachings in a later filed non-provisional application.

All ranges disclosed herein are to be understood to encompass the beginning and ending range values and any and all subranges therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1.0 to 2.7, 3.3 to 8.9, 5.7 to 10, etc. A limitation such as "at least one selected from the group consisting of" is intended to provide support for "at least two," "at least three," and so forth up to and including an embodiment including all elements in such a list. It is envisioned that an individual numerical value for a parameter, temperature, weight, percentage, etc., disclosed herein in any form, such as presented in a table, provides support for the use of such value as the endpoint of a range. A range may be bounded by two such values.

The invention claimed is:

1. A method of making a low density porous solid silver article comprising:

a. providing an acidified aqueous dispersing polymer solution, b. providing an aqueous solution of a reducing agent, c. providing an aqueous silver salt solution, d. contacting the silver salt and the reducing agent solution to the aqueous dispersing polymer solution to form a final solution, from which silver ribbons precipitate e. dispersing the silver ribbons with water or an organic solvent, and f. removing the water or organic solvent so that the porous solid silver article remains, wherein the silver article has a density of less than 3 $g/cm^3$ and g. heating the porous solid silver article at a temperature of 100 to 450° C. for 1 to 120 minutes.

2. The method of claim 1, wherein (f) comprises:

allowing the water or the organic solvent to evaporate, or filtering the silver ribbons from the water or the organic solvent to form a wet cake and allowing the water or the organic solvent to evaporate from the wet cake.

3. The method of claim 2, wherein the water or organic solvent is evaporated at about 45° C.

4. The method of claim 1, further comprising, after (1):

h. mechanically breaking up the porous solid silver article into particles.

5. The method of claim 4, further comprising after (h):

i. packing the particles in a mold and applying heat to fuse the particles together in order to produce a low density silver monolith.

6. The method of claim 5, further comprising after (i):

j. depositing catalytic materials, energy storage materials, or energy generation materials on the low density silver monolith.

7. The method of claim 5, further comprising after (h) and before (i):

k. passing the particles through one or more mesh screens to obtain screened particles having an average size equal to or smaller than a size of openings in the one or more mesh screens, and wherein only the screened particles are packed in the mold in (i).

8. The method of claim 1, wherein the acidified aqueous dispersing polymer solution includes a rigid rod polymer selected from the group consisting of sulfonates of naphthalene, carboxylates of naphthalene, phosphates of naphthalene, and combinations thereof.

9. The method of claim 8, wherein the rigid rod polymer is poly-naphthalene sulfonic acid.

10. The method of claim 8, wherein a concentration of the rigid rod polymer in the final solution is about 4 to about 40 grams per mole of silver.

11. The method of claim 1, wherein the acidified aqueous dispersing polymer solution includes an acid selected from the group consisting of HCl, $H_2SO_4$, $HNO_3$, $HClO_4$, and combinations thereof.

12. The method of claim 11, wherein the acid is $HNO_3$.

13. The method of claim 11, wherein a concentration of the acid in the final solution is from about 0.001 to 0.5 M.

14. The method of claim 1, wherein the reducing agent is selected from the group consisting of ascorbic acid, erythorbic acid, citric acid, oxalic acid, formic acid, $LiAlH_4$, $NaBH_4$, $SnCl_2$, sulfites, hydrazine, phosphorous acid, phosphites, and combinations thereof.

15. The method of claim 14, wherein the reducing agent is at least one of ascorbic acid and erythorbic acid.

16. The method of claim 14, wherein a concentration of the reducing agent in the final solution is about 0.001 to about 1 M.

17. The method of claim 1, wherein the silver salt is selected from the group consisting of silver nitrate, silver chloride, silver bromide, silver iodide, silver phosphate, silver sulfate, and combinations thereof.

18. The method of claim 17, wherein the silver salt is silver nitrate.

19. The method of claim 17, wherein a concentration of the silver salt provides silver ions at a concentration of about 0.0001 to 0.35 M in the final solution.

* * * * *